US005145491A

United States Patent [19]

Schmitt et al.

[11] Patent Number: 5,145,491

[45] Date of Patent: Sep. 8, 1992

[54] PROCESS OF CONTROLLING THE STARTING UP OF THE GASIFICATION OF SOLID FUELS IN A FLUIDIZED STATE

[76] Inventors: Gerhard Schmitt, Schmitten; Horst Mielke, Neu-Isenburg; Peter Herbert, Frankfurt am Main, all of Fed. Rep. of Germany

[21] Appl. No.: 777,815

[22] Filed: Oct. 15, 1991

[30] Foreign Application Priority Data

Nov. 7, 1990 [DE] Fed. Rep. of Germany ..... 4035293

[51] Int. Cl.[5] ..... C10J 3/54

[52] U.S. Cl. ..... 48/197 R; 48/203; 48/206; 48/210; 48/DIG. 4

[58] Field of Search ..... 48/197 R, 203, 206, 48/209, 210, DIG. 4, DIG. 10; 252/373; 431/6, 7; 110/342, 345, 347; 122/4 D

[56] References Cited

U.S. PATENT DOCUMENTS

| | | | |
|---|---|---|---|
| 4,113,445 | 9/1978 | Gettert et al. | 431/6 |
| 4,255,135 | 3/1981 | Grim | 431/7 |
| 4,338,074 | 7/1982 | Johansson | 431/6 |
| 4,353,712 | 10/1982 | Marion et al. | 48/197 R |
| 4,378,974 | 4/1983 | Petit et al. | 48/197 R |
| 4,594,967 | 6/1981 | Wolowodark | 110/347 |
| 4,809,624 | 3/1989 | Van Der Bungt | 110/347 |
| 4,881,949 | 11/1989 | Brungel et al. | 48/197 R |
| 5,014,632 | 5/1991 | Fraksson | 110/347 |

FOREIGN PATENT DOCUMENTS

| | | |
|---|---|---|
| 0303851 | 7/1988 | European Pat. Off. . |
| 0257280 | 1/1987 | Fed. Rep. of Germany . |

*Primary Examiner*—Peter Kratz

*Attorney, Agent, or Firm*—Sprung Horn Kramer & Woods

[57] ABSTRACT

Fuels are gasified in a fluidized state by a treatment with oxygen-containing gas and water vapor in a gasifying reactor. A solids mixture which contains ash and fine-grained fuels is combusted in a heating-up phase, which precedes the gasification and in which the temperature in the reactor is increased approximately to the temperature desired for the gasification. In a succeeding inertizing phase the supply rate of oxygen-containing gas is decreased and an inert gas is fed to the reactor until the product gas no longer contains free oxygen whereas the temperature is maintained virtually constant. In the succeeding gasification the fuel supply rate is increased and, after an adjusting time, the temperature is maintained virtually constant at the value desired for the gasification in the range from 600° to 1500° C. The gasification temperature is controlled by a change of the fuel supply rate.

6 Claims, 1 Drawing Sheet

Fig.1
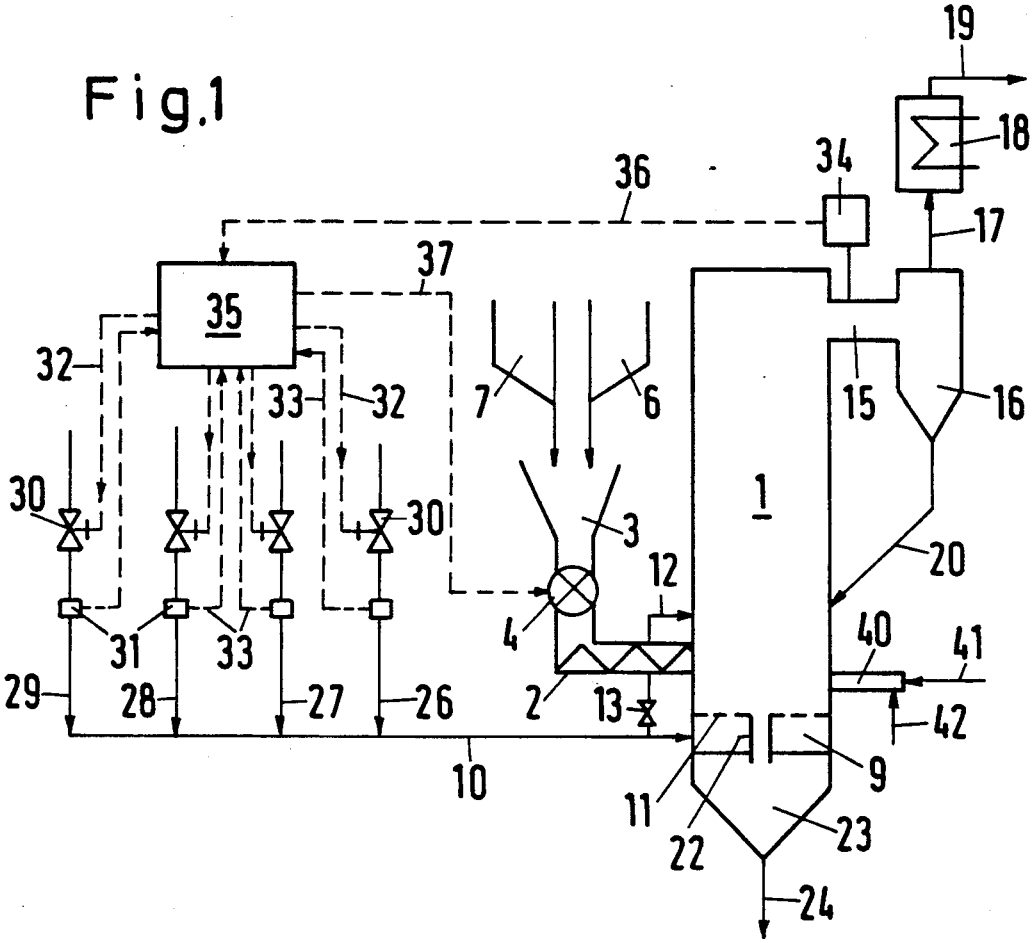
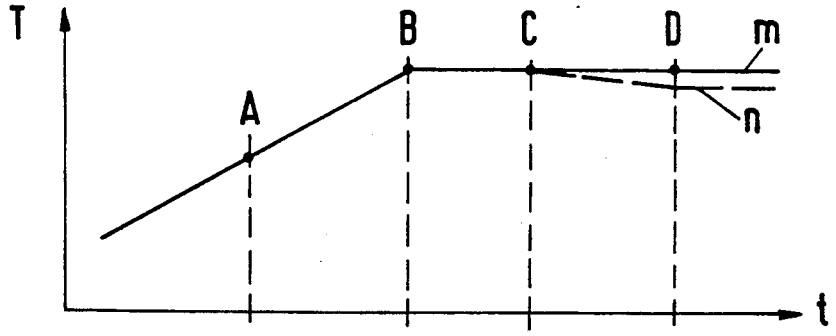
Fig.2a
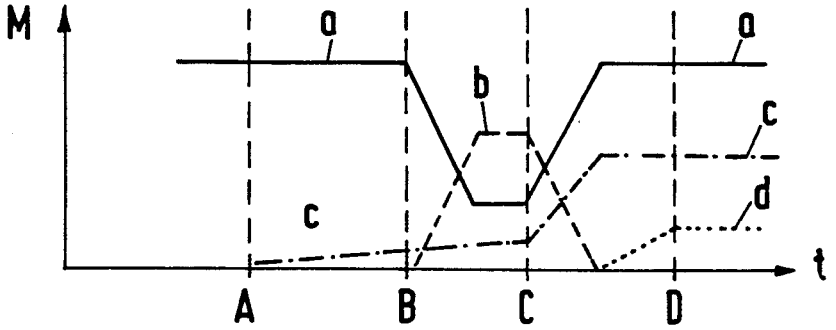
Fig.2b

PROCESS OF CONTROLLING THE STARTING UP OF THE GASIFICATION OF SOLID FUELS IN A FLUIDIZED STATE

This invention relates to a process of controlling the starting up of the gasification of fine-grained solid fuels, which are treated in a fluidized state with oxygen-containing gas and water vapor in a gasifying reactor, which is provided at its end with a duct for discharging product gas and at its bottom portion with means for withdrawing ash. The gasification is effected under a pressure of 1 to 100 bars.

A process of that kind is described in U.S. Pat. No. 4,594,967 and involves a controllable cooperation of several portions of the fluidized bed. The operation is initiated by means of a heating-up burner and the fuel is subsequently supplied with oxygen at a substoichiometric rate until steady-state gasification conditions have been established.

It is an object of the invention to start up the gasifying reactor in an easily controllable manner and to permit the use of a reactor having a simple design. In the process described first herein-before this is accomplished in accordance with the invention in that during the heating-up phase preceding the gasification a mixture of solids comprising ash and fine-grained fuels is combusted in a fluidized state in the reactor with a supply of oxygen-containing gas to provide a hyperstoichiometric supply of oxygen and the temperature in the reactor in thus increased approximately to the temperature desired for the gasification, the heating-up phase is immediately succeeded by an inertizing phase, in which the supply rate of oxygen-containing gas is decreased and an inert gas is supplied to the reactor and the content of free oxygen in the product gas is decreased virtually to zero whereas the temperature is maintained virtually constant, and the inertizing phase is succeeded by the gasification, in which oxygen or oxygen-containing gas and optionally steam are fed to the reactor, the fuel supply rate is increased and the temperature desired for the gasification, which when measured in the top portion of the reactor or in the discharge duct lies in the range from 600° to 1500° C., is maintained virtually constant after a time for temperature adjustment and in which the supply rate of solid fuel is decreased when the temperature is too low and the supply rate of fuel is increased when the temperature is too high. During a steady-state gasification a decrease of the temperature will be avoided because the product gas would otherwise contain undersired products of carbonization.

During the heating-up phase the temperature is gradually increased. In a reactor having a refractory lining it is recommendable to increase the temperature at a rate of about 40° to 120° C. per hour. The supply rate of solid fuel will be decreased when the temperature is too high and the supply rate of solid fuel will be increased when the temperature is too low because the oxygen will then be present in a hyperstoichiometric proportion in the gasifying reactor. Particularly for the sake of economy it will be desirable during the heating-up phase to supply air as an oxygen-containing gas into the reactor. Approximately at the time when the temperature desired for the gasification has been reached at the end of the heating-up phase the supply rate of oxygen-containing gas is decreased and in an inertizing phase the reactor is supplied with inert gas at a progressively increasing rate. The total rate at which gas is supplied will initially remain approximately constant. That inert gas usually consists of recycled product gas, nitrogen or carbon dioxide.

When the reactor has sufficiently been purged with inert gas during the inertizing phase so that the product gas no longer contains oxygen, the gasification may be initiated. For that purpose the reactor is supplied with a gasifying agent, which consists mainly of oxygen (e.g., of air) and of more or less steam. At the beginning of the gasification, during the time for temperature adjustment, the reactor is supplied with inert gas (e.g., $N_2$ or $CO_2$) at a progressively decreasing rate and the reactor is simultaneously supplied with fuel at a higher rate whereas the supply rate of ash is decreased to zero. If the fuel, such as brown coal, has a high water content in itself, the proportion of steam in the mixed gasifying agents may be decreased, possibly to zero. When the gasification has reached a steady state, the temperature is maintained constant within a fluctuation range of ±40° C. This is accomplished by a control of the oxygen supply.

As an additional measure for controlling the temperature in the reactor the supply rate of steam may be varied during the heating-up phase, during the inertizing and during the gasification.

BRIEF DESCRIPTION OF THE DRAWINGS

Further features of the process will be explained with reference to the drawing, in which FIG. 1 is a schematic representation of the gasifying plant, FIG. 2*a* illustrates the temperature change during starting up and FIG. 2*b* illustrates how the supply of fuel and auxiliary substances can be adjusted during starting up.

The reactor 1 shown in FIG. 1 is used for the gasification of solid fuels in a fluidized state. The fuels are fed by a feeder conveyor 2. Coal, brown coal or peat, e.g., may be used as solid fuels. The fuel and inert material are fed from a supply bin 3 via metering means 4 consisting, e.g., of a star wheel feeder. A container 6 for the fuels to be gasified and a container 7 for inert material, particularly ash or sand, are provided over the supply bin 3. For the sake of simplicity, the fuel to be gasified is said to consist of coal and the inert material is said to consist of ash in the following explanations.

The reactor 1 contains in its bottom portion a chamber 9 for distributing gases and/or water vapor, which enter through line 10 and pass through a grate 11 into the reactor 1. A branch line 12 provided with a valve 13 permits the supply of such fluids at a metered rate also to a region above the grate 11 at the same time.

During a steady-state gasification, a circulating fluidized bed is maintained in the reactor 1. In that case a mixture of product gas and solids is conducted through the discharge duct 15 into a cyclone 16 and is separated therein. The product gas flows through line 17 to a waste-heat boiler 18 and is available in line 19 for further use. Because the product gas has high contents of $H_2$ and CO, it may be processed further to form, e.g., a synthesis gas. Solids collected in the cyclone 16 are recycled to the reactor 1 in line 20. Through a pipe 22, which extends centrally through the distributing chamber, low-carbon ash enters the ash chamber 23 and is periodically withdrawn through line 24.

A steam line 26, an oxygen line 27, an air line 28 and an inert gas line 29 are connected to the manifold 10. Each of the lines 26 to 29 is provided with a control valve 30 and with a sensor 31 for measuring the flow rate. The control valves 30 are controlled by a controller 35 via signal lines 32. Each sensor 31 indicates the flow rate in the associated line to the controller 35 via a signal line 33. The temperature in the discharge duct 15 is detected by a temperature sensor 34, which delivers corresponding data via the signal line 36 to the controller 35. In a manner to be described hereinafter the controller 35 effects a semiautomatic or automatic control of the temperature. The supply rate of coal to the reactor 1 is controlled by the control line 37. Details of methods by which that control may be effected will be explained with reference to FIGS. 2*a* and 2*b*.

In FIG. 2*a* the temperature in °C. is plotted along the vertical axis T and the horizontal axis t is the time axis in both FIGS. 2*a* and 2*b* (values, e.g., in hours). Rates (e.g., in kg/h) of substances which are fed to the reactor 1, which rates vary with time, are plotted along the vertical axis M in FIG. 2*b*. The solid line a indicates the course of the rate at which air is supplied through line 28. The line b represents the rate of inert gas supplied through line 29. The dot-and-dash line c represents the coal supply rate, and the dotted line d represents the rate of steam flow through line 26.

For the initial warming up, ash in fed to the reactor 1 and is fluidized by means of hot air. A start-up burner 40 is started at a later time and is supplied through line 41 with gaseous or liquid fuel, such as natural gas or fuel oil, whereas air is supplied through line 42. As a result, a gradually increasing temperature is sensed by the sensor 34 until at the time A coal from the bin 3 is supplied to the reactor 1 via the star wheel feeder 4 at a controlled rate. During the now ensuing heating-up phase, coal is supplied and is fluidized by a supply of air and is combusted in the reactor in the presence of an excess of oxygen so that the temperature is increased further. The start-up burner 40 can now be shut off and the proportion of the ash supplied is decreased toward zero. When the temperature rise is too steep, the supply rate of coal to the reactor will be decreased and will be increased when the rate of temperature rise is lower than desired. An excessively high temperature may be corrected by a supply of steam to the reactor. The controller 35 may be adjusted to the desired temperature manually or as a result of an automatic computation.

The temperature rise in the heating-up phase is continued until the temperature has reached or slightly exceeds the temperature desired for the gasification. This is achieved at the time B in FIG. 2*a*. The inertizing phase is now initiated to eliminate the oxygen content of the product gas. Whereas the temperature is kept constant, the rate at which air is supplied in line 28 to the reactor 1 is decreased and the supply rate of inert gas is increased at the same time. Care is taken to maintain the total rate of air and inert gas approximately constant. In FIG. 2*a*, C indicates the time at which the oxygen content of the product gas has been decreased to zero and at which the inertizing phase is terminated. An analyzer, not shown, is used to determine the oxygen content of the product gas in the duct 15.

The gasifying operation can now be initiated. For this purpose a starting phase, called adjusting time, is first required between times C and D. During that phase the supply rates of coal and oxygen-containing gas are increased whereas the supply of inert gas is gradually shut off. Finally steam at progressively increasing rates can be supplied to the gasifying process; see the dotted line d in FIG. 2*b*. Such controls may be effected automatically or by hand. Care is taken at the same time to maintain the temperature virtually constant or to permit only a slight temperature drop during the adjusting time, whereafter the temperature remains constant; see the lines m and n in FIG. 2*a*.

During the steady-state gasification beginning at the time D, coal, steam and oxygen (e.g., as air) are supplied to the reactor 1 ideally at constant rates. For instance, 1 kg steam may be used per $sm^3$ of oxygen ($sm^3$ = standard cubic meter). During gasification of brown coal or peat, which have a very high water content, the rate of steam may be reduced or the supply of steam may be omitted.

During the gasifying operation the temperature is controlled by control of the supply of coal through the star wheel feeder 4. More coal will be fed to the reactor 1 when the temperature is too high and less coal when the temperature is too low. It is recommendable to maintain the temperature constant during the gasification within a fluctuation range of ±40° C., preferably ±30° C.

EXAMPLE

In a plant as shown on the drawing, 21,318 kg coal are gasified per hour. The reactor 1 is 2.5 m in diameter and above the grate 11 has a height of 15 m. The coal to be gasified is a coal mixture having a lower calorific value of 5579 kcal/kg, a water content of 24% by weight and an ash content of 8.3% by weight. The coal has the following elementary analysis (calculated without water and ash):

| | | |
|---|---|---|
| C | 79% | by weight |
| H | 5.4% | by weight |
| O | 12.1% | by weight |
| N | 3.5% | by weight |
| | 100.0% | by weight |

The combustion and gasification are effected without commercially pure oxygen, only with air, nitrogen and water vapor. No secondary air is supplied through line 12.

For the first heating up up to about 350° C., hot air at 420° C. is fed into the reactor, which contains ash in an increasing quantity up to 1000 kg. Thereafter the burner 40 is additionally operated and is fed with fuel oil at a progressively increasing rate of up to 361 kg/h. After a heating up for 8 hours, a temperature of 600° C. has been reached in the duct 15. At that temperature the supply of coal into the reactor begins; this corresponds to the point A in FIGS. 2*a* and 2*b*. The rates at which coal and auxiliary substances are supplied at various times are stated (in kg/h) in the following table, as well as the temperatures in the duct 15. Points A to D refer to FIGS. 2*a* and 2*b* and the timing of the rates of supply to the reactor is also apparent from FIG. 2*b*.

| | Time (h) | | | | | |
|---|---|---|---|---|---|---|
| | 8 | 13 | 13.5 | 14 | 15 | 16 |
| | Duration (h) | | | | | |
| Time | A | B | | C | | D |
| Coal | 0 | 1764 | 1764 | 1764 | 21318 | 21318 |
| Air | 38767 | 38767 | 14853 | 14853 | 38767 | 38767 |
| Nitrogen | 0 | 0 | 23914 | 23914 | 0 | 0 |
| Steam | 0 | 0 | 0 | 0 | 0 | 2000 |
| Fuel oil | 361 | 0 | 0 | 0 | 0 | 0 |
| Temperature | 600 | 950 | 950 | 950 | 950 | 920 |

The composition of the gas in the duct 15 is at different times:

| Time | | A | B | C |
|---|---|---|---|---|
| $CO_2$ | (% by vol.) | 1.9 | 6.69 | 6.69 |
| $H_2O$ | (% by vol.) | 1.9 | 2.74 | 2.74 |
| $O_2$ | (% by vol.) | 17.9 | 13.13 | 0 |
| $N_2$ | (% by vol.) | 78.3 | 77.44 | 90.57 |

When the steady-state gasification begins at time D, a product gas having the following composition is produced:

| | |
|---|---|
| $CH_4$ | 2.5% by vol. |
| $H_2$ | 14.7% by vol. |
| CO | 20.8% by vol. |
| $CO_2$ | 7.0% by vol. |
| $N_2$ | 48.8% by vol. |
| $H_2O$ | 6.2% by vol. |

For the control of the temperature in the interval of time between times A and B, during which combustion air is supplied at a rate of 38,767 $sm^3/h$, it must be borne in mind that the coal supply rate must be decreased or increased by 20 kg/h in case of an increase or decrease of the temperature by 10° C. relative to the desired value in order to bring the temperature to the desired value.

The steady-state gasification is carried out at the desired temperature of 920° C., a coal supply rate of 21,318 kg/h and an air supply rate of 38,767 kg/h. The coal supply rate must be changed by 150 kg/h in case of a temperature change by 10° C. in order to restore the desired temperature.

It will be appreciated that the instant specification and claims are set forth by way of illustration and not limitation, and that various modifications and changes may be made without departing from the spirit and scope of the present invention.

What is claimed is:

1. A process of controlling the starting up of the gasification of fine-grained solid fuels, which are treated in a fluidized state with oxygen-containing gas and water vapor in a gasifying reactor, which is provided at its top end with a duct for discharging product gas and at its bottom portion with means for withdrawing ash, which comprises (a) during a heating-up phase preceding the gasification combusting a mixture of solids comprising ash and fine-grained fuels in a fluidized state in the reactor with a supply of oxygen-containing gas to provide a hyperstoichiometric supply of oxygen, thereby increasing the temperature in the reactor approximately to the temperature desired for the gasification, (b) immediately succeeding the heating-up phase by an inertizing phase, in which the supply rate of oxygen-containing gas is decreased and an inert gas is supplied to the reactor and the content of free oxygen in the product gas is decreased virtually to zero whereas the temperature is maintained virtually constant, and (c) succeeding the inertizing phase by the gasification, in which oxygen or oxygen-containing gas are fed to the reactor with or without steam, the fuel supply rate is increased and the temperature desired for the gasification, which when measured in the top portion of the reactor or in the discharge duct lies in the range from 600° to 1500° C., is maintained virtually constant after a time for temperature adjustment, and in which the supply rate of solid fuel is decreased when the temperature is too low and the supply rate of fuel is increased when the temperature is too high.

2. A process according to claim 1, wherein during the heating-up phase (a) the temperature is gradually increased, the supply rate of solid fuel is decreased when the temperature is too high and the supply of solid fuel is increased when the temperature is too low.

3. A process according to claim 1, wherein during the gasification after the adjusting time the temperature is maintained constant within a fluctuation range of ±40° C.

4. A process according to claim 1, wherein during the heating-up phase (a) air is the oxygen-containing gas fed to the reactor.

5. A process according to claim 1, wherein during the inertizing phase (b) carbon dioxide or product gas is used as the inert gas.

6. A process according to claim 1, wherein the total rate of oxygen-containing gas and inert gas is maintained virtually constant during the inertizing phase.

* * * * *

UNITED STATES PATENT AND TRADEMARK OFFICE

CERTIFICATE OF CORRECTION

PATENT NO. : 5,145,491

DATED : September 8, 1992

INVENTOR(S) : Schmitt, et al.

It is certified that error appears in the above-identified patent and that said Letters Patent is hereby corrected as shown below:

Title Page Insert -- [73] Assignee: Metallgesellschaft Ag, Frankfurt Am Main, Fed. Rep. of Germany. --

Signed and Sealed this

Twelfth Day of April, 1994

Bruce Lehman

*Attest:*

BRUCE LEHMAN

*Commissioner of Patents and Trademarks*

*Attesting Officer*